US008789908B2

(12) United States Patent
Yoshida

(10) Patent No.: US 8,789,908 B2
(45) Date of Patent: Jul. 29, 2014

(54) IMAGE RECORDING APPARATUS AND NON-TRANSITORY COMPUTER-READABLE MEDIUM STORING IMAGE PROCESSING PROGRAM

(71) Applicant: Yasunari Yoshida, Aichi-ken (JP)

(72) Inventor: Yasunari Yoshida, Aichi-ken (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/029,761

(22) Filed: Sep. 17, 2013

(65) Prior Publication Data

US 2014/0092157 A1 Apr. 3, 2014

(30) Foreign Application Priority Data

Sep. 28, 2012 (JP) ..... 2012-218335

(51) Int. Cl.
*B41J 29/38* (2006.01)

(52) U.S. Cl.
USPC ..... 347/14; 347/15

(58) Field of Classification Search
CPC ..... B41J 2/04505; B41J 2/04508; B41J 29/38
See application file for complete search history.

(56) References Cited

U.S. PATENT DOCUMENTS 6,964,465 B2 * 11/2005 Endo ..... 347/19

FOREIGN PATENT DOCUMENTS

JP H11-348255 A 12/1999
JP 2011-224796 A 11/2011

* cited by examiner

*Primary Examiner* — Thinh Nguyen
(74) *Attorney, Agent, or Firm* — Merchant & Gould PC

(57) ABSTRACT

An image recording apparatus, including: a recording head to eject a first liquid and a second liquid: and a controller to selectively set one of a first mode and a second mode and to obtain second-liquid ejection amounts for pixels other than specific pixels by applying a first rule and for the specific pixels by applying a second rule where the second mode is set, wherein the second rule is a rule by which a ratio of a usage amount of the second liquid to a usage amount of the first liquid in an instance in which the second rule is applied to the specific pixels in the second mode is made closer to the ratio in an instance in which the first mode is set, as compared with the ratio in an instance in which the first rule is applied to the specific pixels in the second mode.

13 Claims, 9 Drawing Sheets

INK EJECTION DATA

S : SMALL DROPLET

M : MEDIUM DROPLET

L : LARGE DROPLET

SPECIFIC PIXEL

SOLID PORTION

SPECIFIC PIXEL

TREATMENT-LIQUID EJECTION DATA

S : SMALL DROPLET

M : MEDIUM DROPLET

L : LARGE DROPLET

FIG.5A FIRST RULE

| INK | TREATMENT LIQUID |
|---|---|
| DROPLET NON-EJECTION | DROPLET NON-EJECTION |
| SMALL DROPLET | SMALL DROPLET |
| MEDIUM DROPLET | MEDIUM DROPLET |
| LARGE DROPLET | LARGE DROPLET |

FIG.5B SECOND RULE

| INK | TREATMENT LIQUID |
|---|---|
| DROPLET NON-EJECTION | DROPLET NON-EJECTION |
| SMALL DROPLET | DROPLET NON-EJECTION |
| MEDIUM DROPLET | SMALL DROPLET |
| LARGE DROPLET | SMALL DROPLET |

FIG.5C THIRD RULE (THIRD RULE FOR DECREASE)

| INK | TREATMENT LIQUID |
|---|---|
| DROPLET NON-EJECTION | DROPLET NON-EJECTION |
| SMALL DROPLET | SMALL DROPLET |
| MEDIUM DROPLET | MEDIUM DROPLET |
| LARGE DROPLET | MEDIUM DROPLET |

FIG.5D THIRD RULE (THIRD RULE FOR INCREASE)

| INK | TREATMENT LIQUID |
|---|---|
| DROPLET NON-EJECTION | DROPLET NON-EJECTION |
| SMALL DROPLET | MEDIUM DROPLET |
| MEDIUM DROPLET | LARGE DROPLET |
| LARGE DROPLET | LARGE DROPLET |

FIG.5E RELATIONSHIP BETWEEN DROPLET SIZE AND EJECTION AMOUNT

| | INK | TREATMENT LIQUID | TREATMENT LIQUID/INK |
|---|---|---|---|
| DROPLET NON-EJECTION | 0pl | 0pl | ---- |
| SMALL DROPLET | 8pl | 5pl | 0.63 |
| MEDIUM DROPLET | 14pl | 8pl | 0.57 |
| LARGE DROPLET | 20pl | 10pl | 0.50 |

FIG.5F NORMAL RECORDING MODE

| | | NUMBER OF PIXELS | INK EJECTION AMOUNT | TREATMENT-LIQUID EJECTION AMOUNT |
|---|---|---|---|---|
| DROPLET SIZE | DROPLET NON-EJECTION | 10 | 0pl | 0 |
| | SMALL DROPLET | 20 | 160pl | 100pl |
| | MEDIUM DROPLET | 30 | 420pl | 240pl |
| | LARGE DROPLET | 40 | 800pl | 400pl |
| TOTAL | | 100 | 1380pl | 740pl |
| TREATMENT LIQUID/INK | | 0.54 | | |

FIG.5G INK SAVE MODE

| | | NUMBER OF PIXELS | INK EJECTION AMOUNT | TREATMENT-LIQUID EJECTION AMOUNT |
|---|---|---|---|---|
| DROPLET SIZE | DROPLET NON-EJECTION | 15 | 0pl | 0 |
| | SMALL DROPLET | 30 | 240pl | 150pl |
| | MEDIUM DROPLET | 40 | 560pl | 320pl |
| | LARGE DROPLET | 15 | 300pl | 150pl |
| TOTAL | | 100 | 1100pl | 620pl |
| TREATMENT LIQUID/INK | | 0.56 | | |

IMAGE RECORDING APPARATUS AND NON-TRANSITORY COMPUTER-READABLE MEDIUM STORING IMAGE PROCESSING PROGRAM

CROSS REFERENCE TO RELATED APPLICATION

The present application claims priority from Japanese Patent Application No. 2012-218335, which was filed on Sep. 28, 2012, the disclosure of which is herein incorporated by reference in its entirety.

BACKGROUND OF THE INVENTION

1. Field of the Invention

The present invention relates to an image recording apparatus and a non-transitory computer-readable medium storing an image processing program.

2. Description of Related Art

As an image recording apparatus, there is known an ink-jet recording apparatus having a recording head. In the ink-jet recording apparatus, the recording head ejects, to a recording medium, an ink component and a reaction liquid that reacts with the ink component, whereby a high-quality image is formed.

SUMMARY OF THE INVENTION

There is known an image recording apparatus having two sorts of printing modes: a first mode as a normal mode; and a second mode in which a density of an image to be recorded on a recording medium is made different from that in the first mode, by changing an ejection amount of the ink component to the recording medium. Where the reaction liquid is ejected in addition to the ink component in such an image recording apparatus, an ejection amount of the reaction liquid to the recording medium needs to be changed depending upon the printing mode to be selected.

In some cases, a ratio of the ejection amount of the reaction liquid with respect to the ejection amount of the ink component in the first mode cannot be made equal to that in the second mode, depending on a number of droplet sizes of a liquid that can be ejected by the recording head and a volume of each of the droplet sizes. Further, in some cases, an amount of the ink component attached to the recording medium and an amount of the reaction liquid that needs to be attached to the ink component in that amount are not directly proportional to each other. In such cases, there may be caused a problem that the ratio of the ejection amount of the reaction liquid with respect to the ejection amount of the ink component largely fluctuates among a plurality of modes.

It is therefore a first object of the invention to provide an image recording apparatus that reduces a difference, among a plurality of modes, in a ratio of a usage amount of a second liquid which acts on a first liquid for improving its characteristics, with respect to a usage amount of the first liquid by which an image is recorded on a recording medium. It is a second object of the invention to provide a non-transitory computer-readable medium storing an image processing program that reduces the difference among the plurality of modes.

The above-indicated first object may be attained according to a first aspect of the invention, which provides an image recording apparatus, including: a recording head configured to eject, to a recording medium, a first liquid by which an image is recorded on the recording medium and a second liquid that acts on the first liquid so as to improve characteristics of the first liquid; and a controller configured to control the recording head. The controller is configured to perform: mode setting processing in which the controller selectively sets one of a plurality of modes including a first mode in which an image to be recorded based on image data is identified as a recording image which is an image to be recorded and a second mode in which an image having a density different from a density of the image to be recorded based on the image data in the first mode is identified as the recording image, the image data containing density values each for a corresponding one of a plurality of pixels arranged in matrix; first-data generating processing in which the controller generates first-liquid ejection data indicating an ejection amount of the first liquid for each of the plurality of pixels of the recording image; second-data generating processing in which the controller generates second-liquid ejection data indicating an ejection amount of the second liquid for each of the plurality of pixels of the recording image; and image-recording-control processing in which the controller controls the recording head to eject the first liquid and the second liquid to the recording medium according to the first-liquid ejection data and the second-liquid ejection data. The controller generates the second-liquid ejection data in the second-data generating processing such that, where the second mode is set in the mode setting processing, the ejection amount of the second liquid for each pixel other than specific pixels in the plurality of pixels of the recording image is obtained by applying a first rule common to the plurality of modes while the ejection amount of the second liquid for each of the specific pixels is obtained by applying a second rule that corresponds to the second mode and that is different from the first rule. Where a ratio of a usage amount of the second liquid ejected from the recording head with respect to a usage amount of the first liquid ejected from the recording head is defined as a usage-amount ratio, the second rule is a rule by which the usage-amount ratio in an instance in which the second rule is applied to the specific pixels in the second mode is made closer to the usage-amount ratio in an instance in which the first mode is set in the mode setting processing, as compared with the usage-amount ratio in an instance in which the first rule is applied to the specific pixels in the second mode.

The above-indicated second object may be attained according to a second aspect of the invention, which provides a non-transitory computer-readable storage medium in which is stored an image processing program to be executed by a computer of information processing device that is communicable with an image recording apparatus having a recording head configured to eject, to a recording medium, a first liquid by which an image is recorded on the recording medium and a second liquid that acts on the first liquid so as to improve characteristics of the first liquid. The image processing program permits the computer to function as a controller to perform: mode setting processing in which the controller selectively sets one of a plurality of modes including a first mode in which an image to be recorded based on image data is identified as a recording image which is an image to be recorded and a second mode in which an image having a density different from a density of the image to be recorded based on the image data in the first mode is identified as the recording image, the image data containing density values each for a corresponding one of a plurality of pixels arranged in matrix; first-data generating processing in which the controller generates first-liquid ejection data indicating an ejection amount of the first liquid for each of the plurality of pixels of the recording image; second-data generating processing in which the controller generates second-liquid ejection data indicating an ejection amount of the second liquid for each of the plurality of pixels of the recording image; and image-recording-control processing in which the controller controls the recording head to eject the first liquid and the second liquid to the recording medium according to the first-liquid ejection data and the second-liquid ejection data. The controller generates the second-liquid ejection data in the second-data generating processing such that, where the second mode is set in the mode setting processing, the ejection amount of the second liquid for each pixel other than specific pixels in the plurality of pixels of the recording image is obtained by applying a first rule common to the plurality of modes while the ejection amount of the second liquid for each of the specific pixels is obtained by applying a second rule that corresponds to the second mode and that is different from the first rule. Where a ratio of a usage amount of the second liquid ejected from the recording head with respect to a usage amount of the first liquid ejected from the recording head is defined as a usage-amount ratio, the second rule is a rule in which the usage-amount ratio in an instance in which the second rule is applied to the specific pixels in the second mode is closer to the usage-amount ratio in an instance in which the first mode is set in the mode setting processing, as compared with the usage-amount ratio in an instance in which the first rule is applied to the specific pixels in the second mode.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which:

FIG. 5A is a table for explaining a first rule, FIG. 5B is a table for explaining a second rule, FIGS. 5C and 5D are tables for explaining a third rule, FIG. 5E is a table for explaining a relationship between a droplet size and an ejection amount, FIG. 5F is a table for explaining a usage-amount ratio in a normal recording mode, and FIG. 5G is a table for explaining the usage-amount ratio in an ink save mode;

DETAILED DESCRIPTION OF THE EMBODIMENTS

<First Embodiment>

There will be hereinafter described a first embodiment of the present invention with reference to the drawings. In the following description, an ink-jet printer is illustrated as one example of an image recording apparatus.

Figure 1:
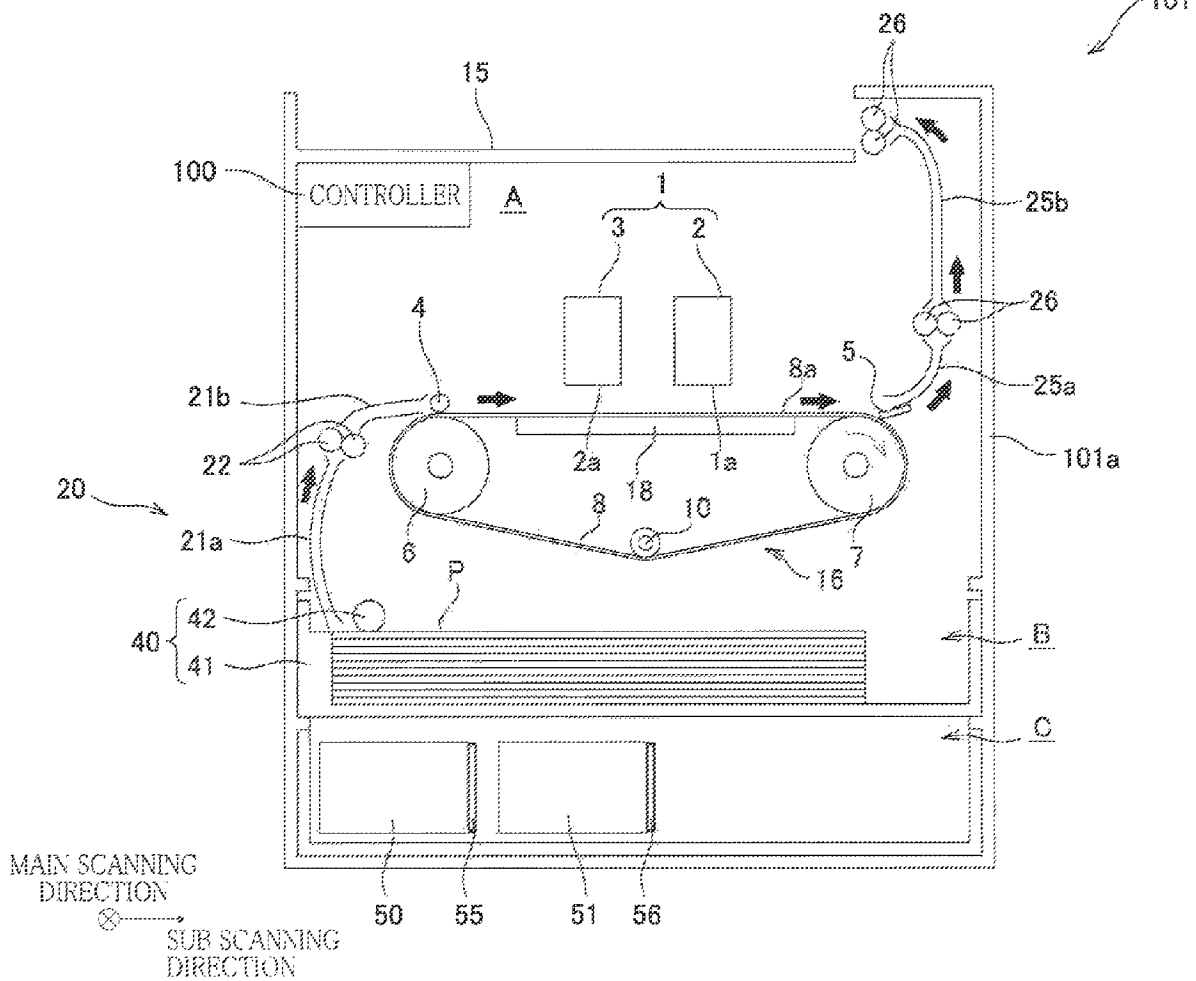
FIG. 1 is a side view schematically showing an internal structure of an ink-jet printer according to a first embodiment of the present invention.

Referring first to FIG. 1, there will be explained an overall structure of the ink-jet printer. The ink-jet printer generally indicated at 101 in FIG. 1 has a housing 101*a* having a rectangular parallelepiped shape. A sheet receiving portion 15 is provided on a top plate of the housing 101*a*. In an inner space defined by the housing 101*a*, there is formed a sheet conveyance passage extending from a sheet supply mechanism 40 (that will be explained) to the sheet receiving portion 15 along bold arrows shown in FIG. 1. A sheet P as one example of a recording medium is conveyed through the sheet conveyance passage. The inner space of the housing 101*a* is divided into three spaces A, B, and C arranged in order from the top of the housing 101*a*.

In the space A, there are disposed: a recording head 1; a conveyor mechanism 16 configured to convey the sheet P in the horizontal direction (i.e., from the left side to the right side in FIG. 1) such that the sheet P passes right below the recording head 1; a guide mechanism 20 configured to guide the sheet P; and a controller 100 configured to control an overall operation of the ink-jet printer 101.

The recording head 1 includes an ink ejection head 2 and a treatment-liquid ejection head 3. The ink ejection head 2 is a line head having a rectangular parallelepiped shape extending in a main scanning direction and is configured to eject droplets of a black ink to the sheet P. The lower surface of the ink ejection head 2 is an ejection surface 1*a* in which a plurality of ejection openings for ejecting the ink are formed. The ink ejection head 2 is capable of ejecting three sorts of droplets having mutually different sizes, namely, a large droplet, a medium droplet, and a small droplet, by adjusting an ejection amount of the ink. Accordingly, the ink ejection head 2 is capable of representing, on the sheet P, four dot formation types, namely, a density in four-level gray scale, i.e., a large dot corresponding to the large droplet, a medium dot corresponding to the medium droplet, a small dot corresponding to the small droplet, and no dot (droplet non-ejection). The ink is one example of a first liquid.

The treatment-liquid ejection head 3 is a line head that is substantially identical in construction with the ink ejection head 2. The treatment-liquid ejection head 3 is disposed on the upstream side of the ink ejection head 2 and is configured to eject a treatment liquid to the sheet P. The lower surface of the treatment-liquid ejection head 3 is an ejection surface 2*a* in which a plurality of ejection openings for ejecting the treatment liquid are formed. Like the ink ejection head 2, the treatment-liquid ejection head 3 is capable of ejecting three sorts of droplets having mutually different sizes, i.e., a large droplet, a medium droplet, and a small droplet, by adjusting an ejection amount of the treatment liquid. The treatment liquid is one example of a second liquid.

The treatment liquid is a liquid to be ejected to the sheet P prior to ejection of the ink. The treatment liquid acts on the ink for thereby improving characteristics of the ink. In general, a treatment liquid containing a component that coagulates pigments is used for pigment ink, and a treatment liquid containing a component that precipitates dyes is used for dye ink. The treatment liquid may be formed of any liquid containing a cationic high polymer, a polyvalent metal salt such as a magnesium salt, or the like. When the treatment liquid and the ink are mixed with each other, the polyvalent metal salt or the like acts on a coloring agent (dye or pigment) of the ink, whereby an insoluble or hardly soluble metal complex or the like is formed by coagulation or precipitation.

The conveyor mechanism 16 includes two belt rollers 6, 7, a conveyor belt 8, a tension roller 10, a platen 18, a nip roller 4, and a peeling plate 5. The conveyor belt 8 is an endless belt wound around the two belt rollers 6, 7 and undergoes tension given by the tension roller 10. The platen 18 is disposed so as to be opposed to the ink ejection head 2 and the treatment-liquid ejection head 3 and supports the upper portion of the loop of the conveyor belt 8 from inside. The belt roller 7 is a drive roller configured to rotate clockwise in FIG. 1 so as to move or rotate the conveyor belt 8. The belt roller 6 is a driven roller configured to rotate by the movement of the conveyor belt 8. The conveyor belt 8 has a conveyor surface 8*a* on which a silicone layer with low tackiness is formed. The nip roller 4 is configured to press the sheet P conveyed thereto onto the conveyor surface 8*a*. The sheet P pressed by the nip roller 4 is held on the conveyor belt 8*a* by the silicone layer. The peeling plate 5 is configured to peel the sheet P on the conveyor belt 8 away from the conveyor belt 8.

The guide mechanism 20 has an upstream-side guide portion and a downstream-side guide portion that are disposed on one and the other side of the conveyor mechanism 16 in a conveyance direction in which the sheet P is conveyed. The upstream-side guide portion has a guide 21*a*, a guide 21*b*, and a feed roller pair 22 and is configured to convey the sheet P supplied from the sheet supply mechanism 40 (that will be explained) to the conveyor mechanism 16. The downstream-side guide portion has a guide 25*a*, a guide 25*b*, and two feed roller pairs 26 and is configured to convey the sheet P conveyed from the conveyor mechanism 16 toward the sheet receiving portion 15.

In the space B, the sheet supply mechanism 40 is disposed. The sheet supply mechanism 40 has a sheet tray 41 and a sheet supply roller 42. The sheet tray 41 is attachable to and removable from the housing 101*a*. The sheet tray 41 is a box opening upward and is configured to accommodate a plurality of sheets P. The sheet supply roller 42 is configured to supply an uppermost one of the sheets P accommodated in the sheet tray 41.

In the space C, there are disposed an ink tank 50, a treatment-liquid tank 51, an ink sensor 55, and a treatment-liquid sensor 56. The ink tank 50 stores the black ink and is connected to the ink ejection head 2 via a tube and a pump (both not shown). Similarly, the treatment-liquid tank 51 stores the treatment liquid and is connected to the treatment-liquid ejection head 3 via a tube and a pump (both not shown). The ink sensor 55 is configured to detect a remaining amount of the ink in the ink tank 50 and to output a detection result to the controller 100. The treatment-liquid sensor 56 is configured to detect a remaining amount of the treatment liquid in the treatment-liquid tank 51 and to output a detection result to the controller 100.

A touch panel 90 (FIG. 2) is provided on the upper portion of the housing 101*a*. The touch panel 90 is electrically connected to the controller 100. A user can set a printing mode, for instance, by operating the touch panel 90. In the present embodiment, the printing mode includes: a normal recording mode in which an image is recorded on the sheet P in a normal density; and an ink save mode in which an image is recorded on the sheet P in a density lower than that in the normal recording mode. The normal recording mode is one example of a first mode while the ink save mode is one example of a second mode.

The amount of the ink stored in the ink tank 50 and the amount of the treatment liquid stored in the treatment-liquid tank 51, in an initial state, are set as follows. That is, a ratio of the amount of the treatment liquid stored in the treatment-liquid tank 51 with respect to the amount of the ink stored in the ink tank 50 is equal to a ratio of an average value of a total amount of the treatment liquid ejected from the treatment-liquid ejection head 3 when an image is recorded on the sheet P, with respect to an average value of a total amount of the ink ejected from the ink ejection head 2 when the image is recorded on the sheet P, in an instance in which the normal recording mode is selected as the printing mode.

Figure 2:
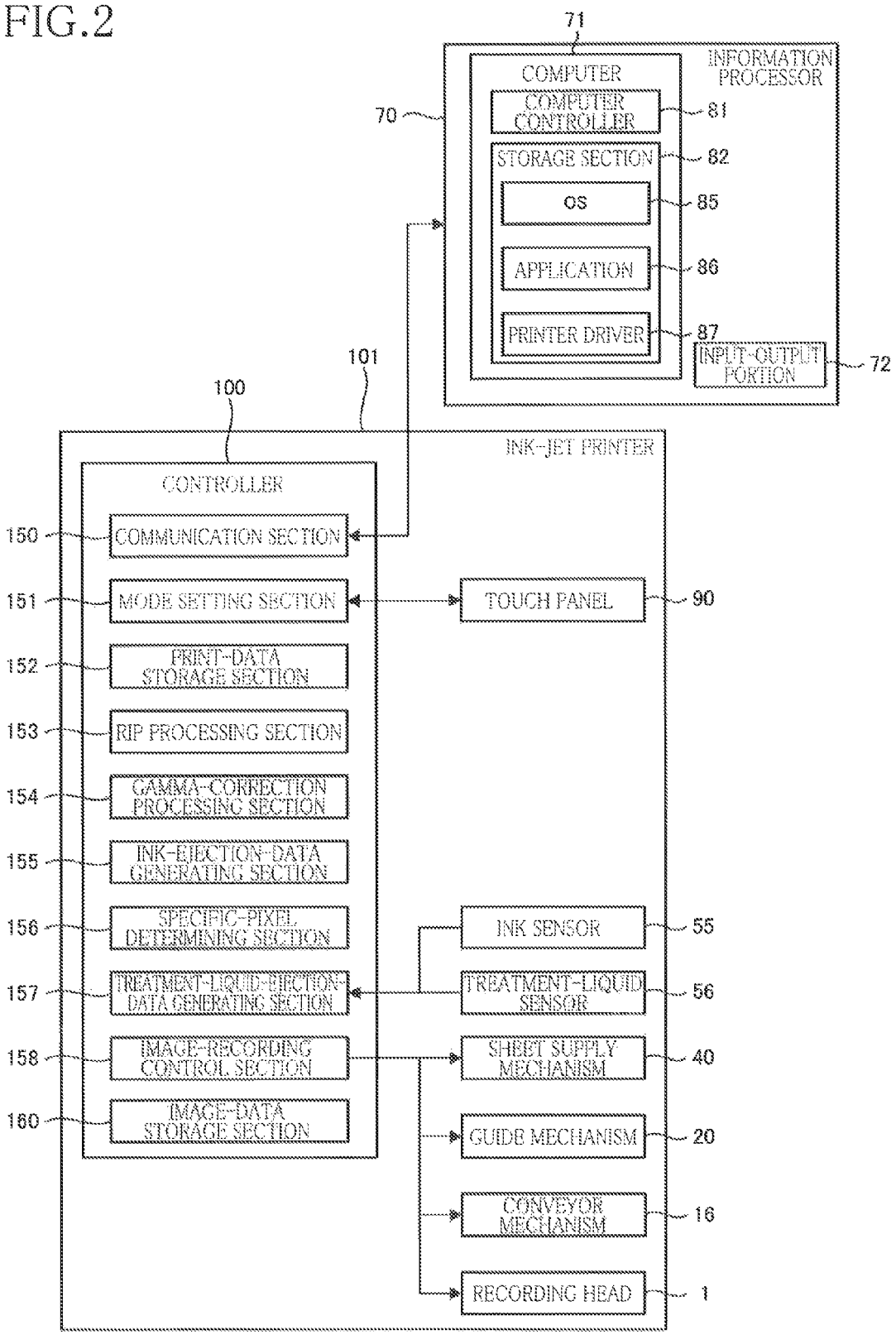
FIG. 2 is a diagram showing an electric structure of the printer of FIG. 1.

Before explaining an electric structure of the ink-jet printer 101, there will be explained, with reference to FIG. 2, an information processor 70 communicably connected to the ink-jet printer 101. The information processor 70 is a general-purpose personal computer (PC) or the like and includes a computer 71 and an input-output portion 72, as shown in FIG. 2. The input-output portion 72 is constituted by: an input device including a keyboard and a mouse; and an output device including a display and so on. The input-output portion 72 enables various operations by the user to be inputted and enables various setting screens, an operating state, and so on to be displayed for recognition by the user.

The computer 71 has a computer controller 81 and a storage section 82. The computer controller 81 controls various sections of the information processor 70 in a centralized manner and includes: a Central Processing Unit (CPU); a Read Only Memory (ROM) that non-rewritably stores programs executed by the CPU and data used when the programs are executed; and a Random Access Memory (RAM) that temporarily stores data when the programs are executed. The storage section 82 is a rewritable, nonvolatile storage device. The storage section 82 stores an operating system (OS) 85, an application 86 for forming documents, images and the like, a printer driver 87 that is a program for enabling the ink-jet printer 101 to be available by the information processor 70.

In the information processor 70, when a printing start operation is performed in the application 86 that is being executed, the printer driver 87 is activated. When the printer driver 87 is activated, print data formed by the application 86 is outputted to the ink-jet printer 101 via a communication interface (not shown). Here, the print data is expressed in a page description language or the like.

The electric structure of the ink-jet printer 101 will be next explained. The controller 100 of the ink-jet printer 101 includes a CPU, a ROM that non-rewritably stores programs executed by the CPU and data used when the programs are executed, and a RAM that temporarily stores data when the programs are executed. The hardware cooperate with software in the ROM to establish various functional sections of the controller 100. As shown in FIG. 2, the controller 100 includes a communication section 150, a mode setting section 151, a print-data storage section 152, an RIP processing section 153, a gamma-correction processing section 154, an ink-ejection-data generating section 155 (first-data generating means), a specific-pixel determining section 156 (specific-pixel determining means), a treatment-liquid-ejection-data generating section 157 (second-data generating means), an image-recording control section 158 (an image-recording control means), and an image-data storage section 160.

The communication section 150 is configured to control communication with an external device such as the information processor 70.

The mode setting section 151 is configured to selectively set one of the normal recording mode and the ink save mode as the printing mode for an image to be recorded on the sheet P. More specifically, the mode setting section 151 controls the touch panel 90 such that an image-quality selecting screen is displayed and thereafter sets the printing mode selected by the user through the touch panel 90, as the printing mode of the image to be recorded on the sheet P. As a modification, the information processor 70 may be configured to add printing command data to the print data when the print data is sent, and the mode setting section 151 may be configured to selectively set one of the normal recording mode and the ink save mode on the basis of the printing command data.

In the print-data storage section 152, there is stored print data that is received by the communication section 150 from the information processor 70. The RIP processing section 153 is configured to perform a known RIP (Raster Image Processor) processing on the print data stored in the print-data storage section 152 such that the print data is converted into image data (bitmap data) in which pixels are disposed in matrix in a printable region of the sheet P and are expressed in 256-level gray scale, in other words, each pixel is expressed in one of gray scale values from 0 to 255. The image data is stored in the image-data storage section 160.

The gamma-correction processing section 154 is configured to convert the image data expressed in the 256-level gray scale by the RIP processing section 153 into recording-image data expressed in 1024-level gray scale (from 0 to 1023). The conversion of the image data expressed in the 256-level gray scale into the recording-image data expressed in the 1024-level gray scale enables a density control, such as error diffusion processing that will be explained later, to be performed more accurately. It is noted that the "recording-image data" is data based on which an image is recorded on the sheet P. In this sense, the image to be recorded based on the recording-image data is referred to as a "recording image" where appropriate.

Figure 3A:
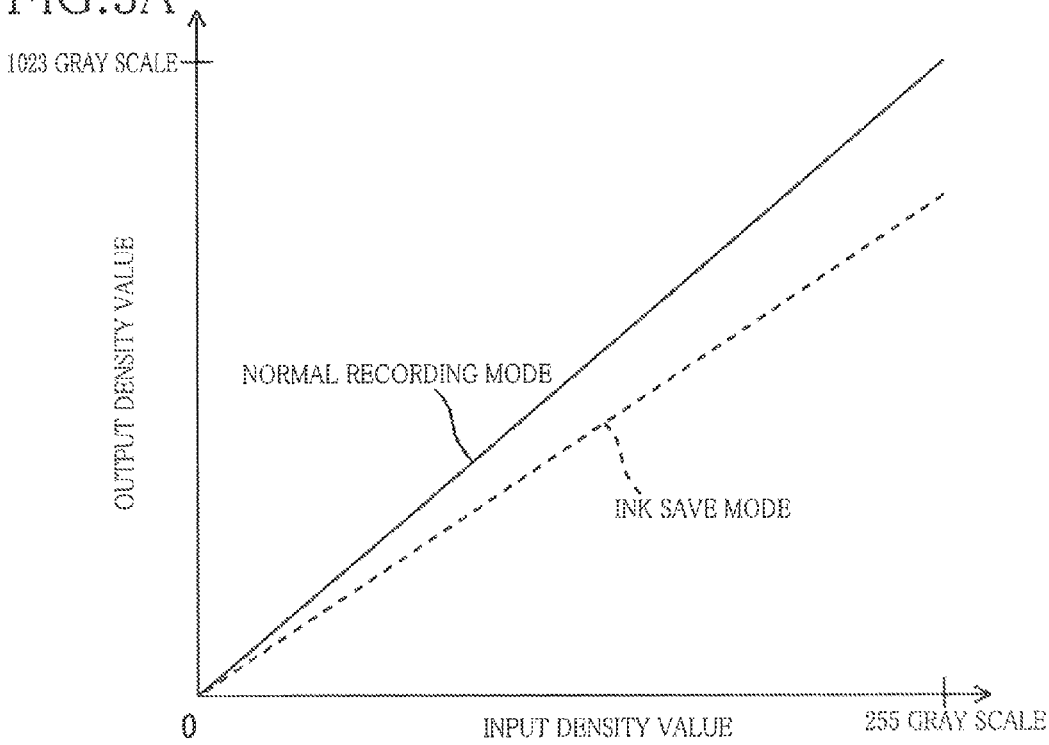
FIG. 3A is a graph showing a relationship between a gray scale value of an input density value and a gray scale value of an output density value in a gamma-correction processing section and FIG. 3B is a graph showing a relationship between an input density value in ink-ejection-data generating section and a usage rate for each droplet size.

FIG. 3A is a graph in which a horizontal axis indicates an input density value in the gamma-correction processing section 154 while a vertical axis indicates an output density value in the gamma-correction processing section 154. The graph of FIG. 3A shows a relationship between a signal of the input density value and a signal of the output density value. As a gray scale value, "0" indicates white while the input density value "255" in the horizontal axis and the output density value "1023" in the vertical axis show black. In an instance where the normal recording mode is set as the printing mode by the mode setting section 151, the relationship between the input density value and the output density value is represented by an inclined line indicated by a solid line in FIG. 3A. On the other hand, in an instance where the ink save mode is set as the printing mode by the mode setting section 151, the gradient of the inclined line that represents the relationship between the input density value and the output density value is made more gentle by the gamma-correction processing section 154, as compared with that in the instance where the normal recording mode is set. To be more specific, the gradient of the inclined line is made gentle as indicated by a dashed line shown in FIG. 3A, such that the input density value "255" in the horizontal axis is converted into a gray scale value obtained by multiplying the output density value "1023" in the vertical axis by a coefficient not greater than 1. For instance, where the coefficient is equal to 0.8, the gradient of the inclined line is made gentle such that the input density value "255" in the horizontal axis becomes approximately equal to 818 obtained by multiplying the output density value "1023" in the vertical axis by the coefficient 0.8, namely, $1023 \times 0.8 \approx 818$. The amount of the ink to be used increases with an increase in the gray scale value. Accordingly, in the ink save mode, the grayscale value of the output density value is made small as a whole, whereby the total amount of the ink to be used in recording the image on the sheet P is reduced.

Figure 4A:
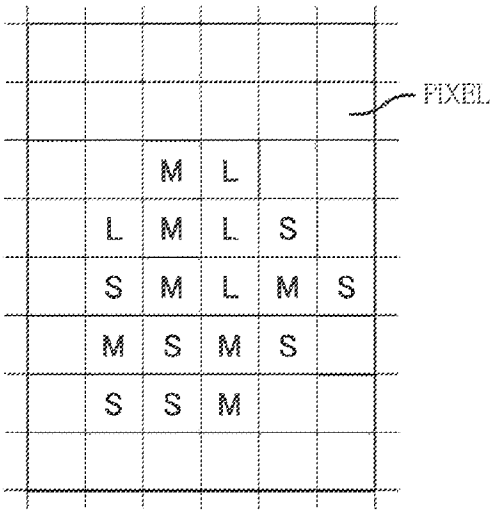
FIG. 4A is a view for explaining ink ejection data.

The ink-ejection-data generating section 155 is configured to perform halftoning processing on the image (the recording image), as an input image, which is based on the image data (the recording-image data) expressed in the 1024-level gray scale by the gamma-correction processing section 154, so as to generate, as an output image, ink ejection data which is expressed in four-level gray scale as shown in FIG. 4A and based on which the ink is ejected. The ink ejection data indicates, in the four-level gray scale, an ink ejection amount of each of pixels of the recording image based on the recording-image data. Values in the four-level gray scale respectively correspond to the large droplet, the medium droplet, the small droplet, and the droplet non-ejection. Here, each of "S", "M", and "L" in FIG. 4A represents a size of a droplet for a corresponding pixel to be ejected from the ink ejection head 2. In FIG. 4A, each of pixels in which none of "S", "M", and "L" are described is a pixel for which an ink droplet is not ejected. The ink ejection data is one example of a first-liquid ejection data.

In the present embodiment, the ink-ejection-data generating section 155 utilizes an error diffusion method as the halftoning processing. The error diffusion method is a method in which, for each of the pixels constituting the input image, the input density value in the 1024-level gray scale of a target pixel is converted into an output value in the four-level gray scale, and an error value, which is obtained by subtracting a relative density value corresponding to the output value from the input density value (a corrected resolved value), is diffused or reflected in not-yet-processed pixels.

Figure 3B:
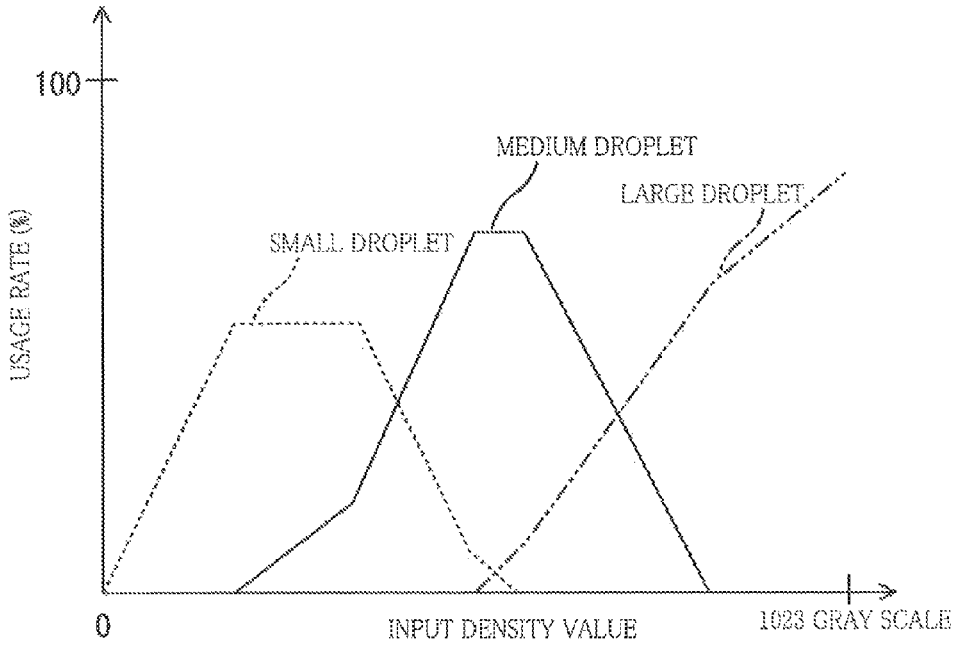

In the present embodiment, there is set in advance a usage rate (generation frequency) of each of the large droplet, the medium droplet, and the small droplet for each of the input density values from "0" to "1023", as shown in FIG. 3B. The error diffusion method is performed according to the setting.

One example of processing according to the error diffusion method will be explained. Initially, there is selected one of the pixels that constitute the input image based on the recording-image data, as a pixel to be processed, i.e., the target pixel. On the basis of the setting shown in FIG. 3B, the input density value of the target pixel is resolved in resolved density values corresponding to the respective droplet sizes. For instance, each resolved density value is equal to a value obtained by multiplying a relative density value of the corresponding droplet size by the usage rate of the corresponding droplet size. For each of the droplet sizes, there is added, to the resolved density value of the target pixel, a stored error value for the target pixel that is managed for each of the droplet sizes. As a result, the corrected resolved value is calculated. Here, the "stored error value" is defined as follows. An error value (that is equal to a value obtained by subtracting the relative density value from the corrected resolved value) generated by the processing previously performed on a previous target pixel is diffused at prescribed ratios to a plurality of not-yet-processed, neighboring pixels located in the neighborhood of the previous target pixel. The stored error value is stored as the error value of each of the neighboring pixels. Where there exists a stored error value for any of the neighboring pixels, a new error value generated by diffusion at the corresponding prescribed ratio is added to the already stored error value. That is, when a certain pixel is processed as the target pixel, there already exists a stored error value for the target pixel that is a sum of values obtained by multiplying error values respectively generated in a plurality of previously processed neighboring pixels by the respective prescribed ratios.

Thereafter, the corrected resolved value and a threshold set for each droplet size are compared, whereby the output value of the target pixel is determined for each droplet size. Then the relative density value corresponding to the output value is subtracted from the corrected resolved value, whereby the error value is calculated for each droplet size. In other words, the error diffusion method is performed in which the resolved density value for each droplet size is utilized as the input density value, and the error value is managed for each droplet size. Each of the thus calculated error values are diffused at the prescribed ratios to the not-yet-processed neighboring pixels as explained above. The processing described above is performed on all of the pixels that constitute the input image based on the recording-image data, so that the ink ejection data in the four-level gray scale is generated.

As described above, in the present embodiment, the usage rate (generation frequency) of each of the large droplet, the medium droplet, and the small droplet for each of the input density values from "0" to "1023" is set in advance. With a decrease in the input density value, the usage rate of the large droplet decreases while the usage rate of the medium droplet and the usage rate of the small droplet increase. Accordingly, in an instance where the ink save mode is set by the mode setting section 151 with respect to the image data sent from the information processor 70, the usage rate of the large droplet is low while the usage rate of the medium droplet and the usage rate of the small droplet are large, as compared with an instance where the normal recording mode is set with respect to the same image data.

Figure 4B:
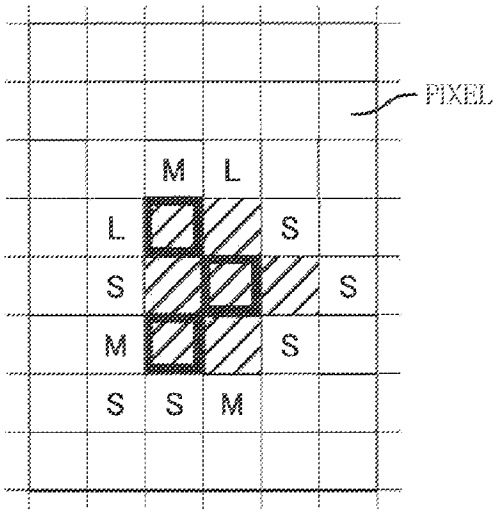
FIG. 4B is a view for explaining specific pixels.

The specific-pixel determining section 156 is configured to determine, on the basis of the ink ejection data generated by the ink-ejection-data generating section 155, a number of specific pixels with respect to a number of all pixels of the recording image based on the ink ejection data and locations of the specific pixels in the recording image. In the present embodiment, the "specific pixel" is defined as follows. In the specific pixel, a treatment-liquid ejection amount to be ejected thereto is adjusted without applying a first rule that will be later explained, such that a ratio of an amount of the treatment liquid used for recording an image on the sheet P with respect to an amount of the ink used for recording the image on the sheet P is made close to a ratio of a treatment-liquid remaining amount in the treatment-liquid tank 51 with respect to an ink remaining amount in the ink tank 50. The specific-pixel determining section 156 is configured to determine the number of the specific pixels and the locations of the specific pixels such that the specific pixels are located only in a solid portion of the recording image. Here, the "solid portion" that exists in the recording image based on the ink ejection data is constituted by some pixels each of which adjoins four pixels, a value in the four-level gray scale of each of the four adjoining pixels corresponding to one of the large droplet, the medium droplet, and the small droplet, as shown in FIG. 4B. In other words, the solid portion is constituted by the pixels each of which adjoins the four pixels in each of which the ink ejection amount is larger than zero. As an alternative, the solid portion may be constituted by pixels each of which adjoins eight pixels in each of which the ink ejection amount is larger than zero.

More specifically, the specific-pixel determining section 156 is configured to determine the specific pixels as follows. The specific-pixel determining section 156 initially obtains pixels that exist in the solid portion, among the plurality of pixels of the recording image based on the ink ejection data, then removes pixels, using a mask pattern, from the pixels existing in the solid portion, and finally determines remaining pixels that remain without being removed, as the specific pixels. In the present embodiment, the mask pattern is common to the normal recording mode and the ink save mode.

The treatment-liquid-ejection-data generating section 157 is configured to generate, on the basis of the ink ejection data generated by the ink-ejection-data generating section 155, treatment-liquid ejection data expressed in the four-level gray scale based on which the treatment liquid is ejected. The treatment-liquid ejection data indicates, in values in the four-level gray scale, a treatment-liquid ejection amount for each of the pixels of the recording image based on the ink ejection data. The values in the four-level gray scale respectively correspond to the large droplet, the medium droplet, the small droplet, and the droplet non-ejection indicated above. The treatment-liquid ejection data is one example of a second-liquid ejection data.

The treatment-liquid-ejection-data generating section 157 will be explained in detail below. The treatment-liquid-ejection-data generating section 157 is configured such that, where the normal recording mode is set as the printing mode by the mode setting section 151, an output value for each of pixels (referred to as "normal pixels") among the plurality of pixels of the recording image based on the ink ejection data, except pixels determined as the specific pixels by the specific-pixel determining section 156, is obtained by applying a first rule while an output value for each specific pixel is obtained by applying a third rule. The "normal pixels" are one example of first-rule-applicable pixels.

Here, the first rule is common to the normal recording mode and the ink save mode. As shown in FIG. 5A, the first rule defines a relationship between the ink ejection amount and the treatment-liquid ejection amount of one pixel of the recording image based on the ink ejection data. In the present embodiment, as shown in FIG. 5A, the treatment liquid in the large droplet size is ejected to a dot to which the ink in the large droplet size is ejected to the sheet P. The treatment liquid in the medium droplet size is ejected to a dot to which the ink in the medium droplet size is ejected to the sheet P. The treatment liquid in the small droplet size is ejected to a dot to which the ink in the small droplet size is ejected to the sheet P.

The third rule defines a relationship between the ink ejection amount and the treatment-liquid ejection amount for one pixel of the recording image based on the ink ejection data where the normal recording mode is set. The third rule is a rule by which a ratio of a usage amount of the treatment liquid ejected from the treatment-liquid ejection head 3 with respect to a usage amount of the ink ejected from the ink ejection head 2 (hereinafter referred to as "usage-amount ratio" where appropriate) in an instance in which the third rule is applied is made closer to a prescribed target value, as compared with the usage-amount ratio in an instance in which the third rule is not applied. In the present embodiment, the "prescribed target value" is a ratio of a treatment-liquid remaining amount in the treatment-liquid tank 51 detected by the treatment-liquid sensor 56 with respect to an ink remaining amount in the ink tank 50 detected by the ink sensor 55 (hereinafter referred to as "remaining-amount ratio" where appropriate).

The third rule includes a third rule for decrease and a third rule for increase. The third rule for decrease is a rule by which the treatment-liquid ejection amount for any of the specific pixels is made smaller as compared with the treatment-liquid ejection amount in an instance in which the first rule is applied to the above-indicated any of the specific pixels, as shown in FIG. 5C, where the usage-amount ratio obtained when the treatment-liquid ejection data is generated by applying the first rule to all of the pixels of the recording image based on the ink ejection data is larger than remaining-amount ratio. In contrast, the third rule for increase is a rule by which the treatment-liquid ejection amount for any of the specific pixels is made larger as compared with the treatment-liquid ejection amount in the instance in which the first rule is applied to the above-indicated any of the specific pixels, as shown in FIG. 5D, where the usage-amount ratio obtained when the treatment-liquid ejection data is generated by applying the first rule to all of the pixels of the recording image based on the ink ejection data is smaller than remaining-amount ratio. Thus, the third rule is applied to each specific pixel to obtain the treatment-liquid ejection amount for the specific pixel, whereby timing at which the ink in the ink tank 50 runs out or is used up and timing at which the treatment liquid in the treatment-liquid tank 51 runs out or is used up can be made substantially the same. The relationship, in the third rule, between the ink ejection amount and the treatment-liquid ejection amount for one pixel of the recording image is determined on the basis of: the number of the specific pixels determined by the specific-pixel determining section 156; the amount of the ink ejected in the normal recording mode obtained from the ink ejection data; the amount of the treatment liquid to be ejected for all of the normal pixels of the recording image; the ink droplet amounts of the respective droplet sizes that can be ejected from the ink ejection head 2; the treatment-liquid droplet amounts of the respective droplet sizes ejected from the treatment-liquid ejection head 3; and the remaining-amount ratio.

In the meantime, when the amount of the treatment liquid ejected to a unit area of the sheet P becomes equal to or larger than a prescribed amount, the fixation property of the ink may be deteriorated, thereby causing a risk of deterioration in quality of the image recorded on the sheet P. Accordingly, in the present embodiment, the treatment-liquid ejection amount for one pixel decreases with an increase in the ink ejection amount for the one pixel. More specifically, as shown in FIG. 5E, the ink droplet amounts (the ejection amounts) of the respective droplet sizes that can be ejected from the ink ejection head 2 are determined such that the small droplet is 8 pl, the medium droplet is 14 pl, and the large droplet is 21 pl. On the other hand, the treatment-liquid droplet amounts (the ejection amounts) of the respective droplet sizes that can be ejected from the treatment-liquid ejection head 3 are determined such that the small droplet is 5 pl, the medium droplet is 8 pl, and the large droplet is 10 pl. Accordingly, a ratio of the treatment-liquid ejection amount with respect to the ink ejection amount (hereinafter referred to as "treatment-liquid-ratio" where appropriate) when the ink and the treatment liquid each in the small droplet size are ejected for one pixel is equal to 0.63. The treatment-liquid-ratio when the ink and the treatment liquid each in the medium droplet size are ejected for one pixel is equal to 0.57. The treatment-liquid-ratio when the ink and the treatment liquid each in the large droplet size are ejected for one pixel is equal to 0.50. As a result, in the ink save mode wherein the usage rate of the large droplet is high while the usage rate of the medium droplet and the usage rate of the small droplet are high, the usage-amount ratio (that is the ratio of the usage amount of the treatment liquid ejected from the treatment-liquid ejection head 3 with respect to the usage amount of the ink ejected from the ink ejection head 2) is larger, as compared with that in the normal recording mode.

More specifically, for certain image data (100-pixel image data) stored in the image-data storage section 160, for instance, the numbers of pixels for the large droplet, the medium droplet, and the small droplet, and the droplet non-ejection in the ink-ejection data in the normal recording mode are 40 pixels, 30 pixels, 20 pixels, and 10 pixels, respectively, as shown in FIG. 5F while the numbers of pixels for the large droplet, the medium droplet, the small droplet, and the droplet non-ejection in the ink-ejection data in the ink save mode are 15 pixels, 40 pixels, 50 pixels, and 15 pixels, respectively, as shown in FIG. 5G. In this case, the usage-amount ratio in the normal recording mode is 0.54 whereas the usage-amount ratio in the ink save mode is 0.56. Thus, where the ink save mode is selected as the printing mode in recording an image on the sheet P, the timing at which the treatment liquid in the treatment-liquid tank 51 runs out or is used up becomes earlier than the timing at which the ink in the ink tank 50 runs out or is used up.

In view of the above, in the present embodiment, the treatment-liquid-ejection-data generating section 157 is configured such that, where the ink save mode is set as the printing mode by the mode setting section 151, the output value for each of the normal pixels among the plurality of pixels of the recording image based on the ink ejection data is obtained by applying the first rule while the output value for each of the specific pixels is obtained by applying a second rule. Here, the second rule is a rule that defines a relationship between the ink ejection amount and the treatment-liquid ejection amount for one pixel of the recording image based on the ink ejection data where the ink save mode is set. The second rule is a rule by which the usage-amount ratio (that is the ratio of the usage amount of the treatment liquid ejected from the treatment-liquid ejection head 3 with respect to the usage amount of the ink ejected from the ink ejection head 2) in an instance in which the second rule is applied to the specific pixels in the ink save mode is made closer to the usage-amount ratio in an instance in which the normal recording mode is set as the printing mode by the mode setting section 151, as compared with the usage-amount ratio in an instance in which the first rule is applied to the specific pixels in the ink save mode. In the present embodiment, as described above, the usage-amount ratio in the normal recording mode is arranged to be close to the remaining-amount ratio that is the ratio of the treatment-liquid remaining amount in the treatment-liquid tank 5 lwith respect to the ink remaining amount in the ink tank 50. In other words, the second rule is a rule for making the usage-amount ratio close to the remaining-amount ratio. The relationship, in the second rule, between the ink ejection amount and the treatment-liquid ejection amount for one pixel of the recording image is determined on the basis of: the number of the specific pixels determined by the specific-pixel determining section 156; the amount of the ink ejected in the ink save mode obtained from the ink ejection data; the amount of the treatment liquid to be ejected for all of the normal pixels of the recording image; the ink droplet amounts of the respective droplet sizes that can be ejected from the ink ejection head 2; the treatment-liquid droplet amounts of the respective droplet sizes ejected from the treatment-liquid ejection head 3; and the remaining-amount ratio.

As explained above, the usage-amount ratio (that is the ratio of the usage amount of the treatment liquid with respect to the usage amount of the ink) in the ink save mode is larger than that in the normal recording mode. Accordingly, the second rule in the present embodiment is a rule by which the treatment-liquid ejection amount for any of the specific pixels is made smaller than that when the first rule is applied to the above-indicated any of the specific pixels, as shown in FIG. 5B.

Figure 4C:
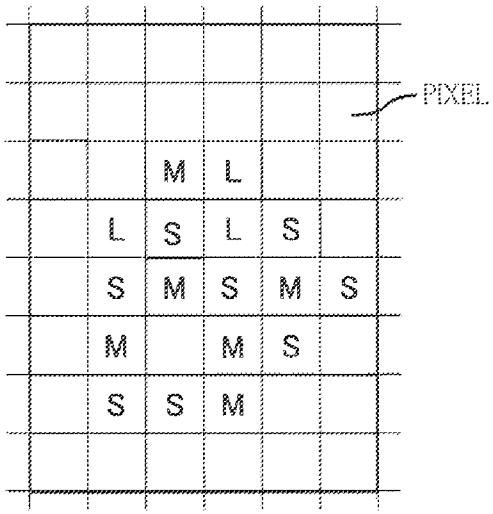
FIG. 4C is a view for explaining treatment-liquid ejection data.

FIG. 4C shows the treatment-liquid ejection data generated by the treatment-liquid-ejection-data generating section 157 when the ink save mode is set as the printing mode by the mode setting section 151. In FIG. 4C, each of "S", "M", and "L" represents the droplet size of the treatment liquid for the corresponding pixel, and each of pixels in which none of "S", "M", and "L" are described is a pixel for which the droplet is not ejected. It is noted that "S", "M", and "L" respectively correspond to the small droplet, the medium droplet, and the large droplet that are ejected from the treatment-liquid ejection head 3. As shown in FIG. 4C, the treatment-liquid ejection amount for each specific pixel is made smaller, as compared with that when the first rule is applied to the above-indicated any of the specific pixels.

The image-recording control section 158 is configured to control the recording head 1, the conveyor mechanism 16, the guide mechanism 20, and the sheet supply mechanism 40, such that an image is recorded on the sheet P. To be more specific, the image-recording control section 158 is configured to control the sheet supply mechanism 40, the guide mechanism 20, and the conveyor mechanism 16, such that the sheet P is conveyed from the sheet supply mechanism 40 to the sheet receiving portion 15. Further, the image-recording control section 158 is configured to control the treatment-liquid ejection head 3 according to the treatment-liquid ejection data generated by the treatment-liquid-ejection-data generating section 157 to eject the treatment liquid to the sheet P and to control the ink ejection head 2 according to the ink ejection data generated by the ink-ejection-data generating section 155 to eject the ink to the sheet P.

<Operation of Printer>

Figure 6:
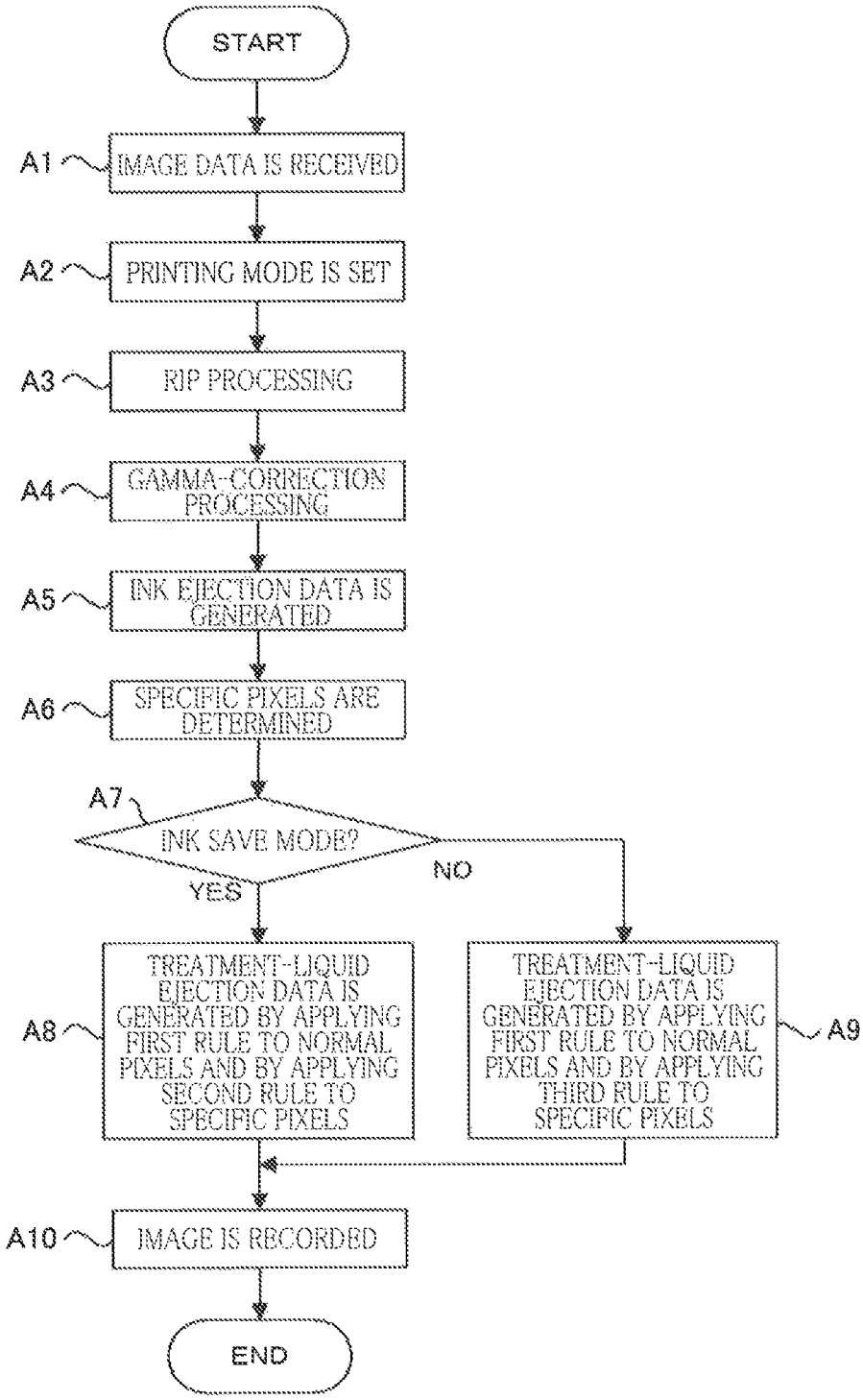
FIG. 6 is a flow chart showing an operation of the printer of FIG. 1.

Referring next to FIG. 6, there will be explained one example of an operation of the ink-jet printer 101. Initially, when the communication section 150 receives print data from the information processor 70, the received print data is stored in the print-data storage section 152 (step A1). (Hereinafter, "step" is omitted where appropriate.) Subsequently, the mode setting section 151 selectively sets one of the normal recording mode and the ink save mode as the printing mode for recording an image on the sheet P, on the basis of an operation by the user inputted through the touch panel 90 (A2).

Then the RIP processing section 153 performs the RIP processing on the print data stored in the print-data storage section 152 for converting the print data into the image data expressed in the 256-level gray scale, so that the image data is stored in the image-data storage section 160 (A3). Subsequently, the gamma-correction processing section 154 converts the image data expressed in the 256-level gray scale by the RIP processing section 153 into the recording-image data expressed in the 1024-level gray scale (A4). On this occasion, the gamma-correction processing section 154 sets the relationship between the input density value and the output density value to the inclined line indicated by the solid line in FIG. 3A where the normal recording mode is set as the printing mode by the mode setting section 151. On the other hand, the gamma-correction processing section 154 sets the relationship between the input density value and the output density value to the inclined line indicated by the dashed line in FIG. 3A where the ink save mode is set as the printing mode by the mode setting section 151.

Subsequently, the ink-ejection-data generating section 155 performs the halftoning processing on the recording image, as the input image, which is based on the recording-image data expressed in the 1024-level gray scale by the gamma-correction processing section 154, thereby generating the ink ejection data (A5). Then the specific-pixel determining section 156 determines the number of the specific pixels with respect to the number of all pixels of the recording image based on the ink ejection data and the locations of the specific pixels in the recording image, on the basis of the ink ejection data generated by the ink-ejection-data generating section 155 (A6).

Where the ink save mode is set as the printing mode by the mode setting section 151 (A7: YES), the treatment-liquid-ejection-data generating section 157 generates the treatment-liquid ejection data such that the output values of the normal pixels among the plurality of pixels of the recording image based on the ink ejection data are obtained by applying the first rule to the normal pixels while the output values of the specific pixels among the plurality of pixels of the recording image are obtained by applying the second rule to the specific pixels (A8). After this step A8, processing in step A10 is executed.

On the other hand, where the normal recording mode is set as the printing mode by the mode setting section 151 (A7: NO), the treatment-liquid-ejection-data generating section 157 generates the treatment-liquid ejection data such that the output values of the normal pixels among the plurality of pixels of the recording image based on the ink ejection data are obtained by applying the first rule to the normal pixels while the output value of the specific pixels among the plurality of pixels of the recording image are obtained by applying the third rule to the specific pixels (A9). After this step A9, processing in step A10 is executed.

In Step A10, the image-recording control section 158 controls the recording head 1, the conveyor mechanism 16, the guide mechanism 20, and the sheet supply mechanism 40, such that an image is recorded on the sheet P. More specifically, the image-recording control section 158 controls the sheet supply mechanism 40, the guide mechanism 20, and the conveyor mechanism 16, such that the sheet P is conveyed from the sheet supply mechanism 40 to the sheet receiving portion 15. Further, the image-recording control section 158 controls the treatment-liquid ejection head 3 according to the treatment-liquid ejection data generated by the treatment-liquid-ejection-data generating section 157 to eject the treatment liquid to the sheet P and controls the ink ejection head 2 according to the ink ejection data generated by the ink-ejection-data generating section 155 to eject the ink to the sheet P. The operation of the ink-jet printer 101 in the first embodiment has been so far explained.

As explained above, according to the present embodiment, the second rule is applied to the specific pixels where the ink save mode is set as the printing mode. Accordingly, the usage-amount ratio (that is the ratio of the usage amount of the treatment liquid ejected from the treatment-liquid ejection head 3 with respect to the usage amount of the ink ejected from the ink ejection head 2) in the instance in which second rule is applied to the specific pixels in the ink save mode can be made closer to the usage-amount ratio in the instance in which the normal recording mode is set, as compared with the usage-amount ratio in the instance in which the first rule is applied to the specific pixels in the ink save mode. As a result, it is possible to reduce a difference in the usage-amount ratio between the normal recording mode and the ink save mode.

Further, according to the present embodiment, the usage-amount ratio is made closer to the prescribed target value where the normal recording mode is set as the printing mode. Accordingly, the usage-amount ratio is made closer to the prescribed target value also in the ink save mode. Because the usage-amount ratio is made closer to the prescribed target value in all printing modes, it is possible to simplify to manage the usage-amount ratio.

Moreover, in the present embodiment, the specific pixels are located in the solid portion of the recording image. Hence, as compared with a case in which the specific pixels are located in an edge of an image, it is possible to reduce deterioration of the image quality of the recording image to be recorded on the sheet P.

<Second Embodiment>

Figure 7:
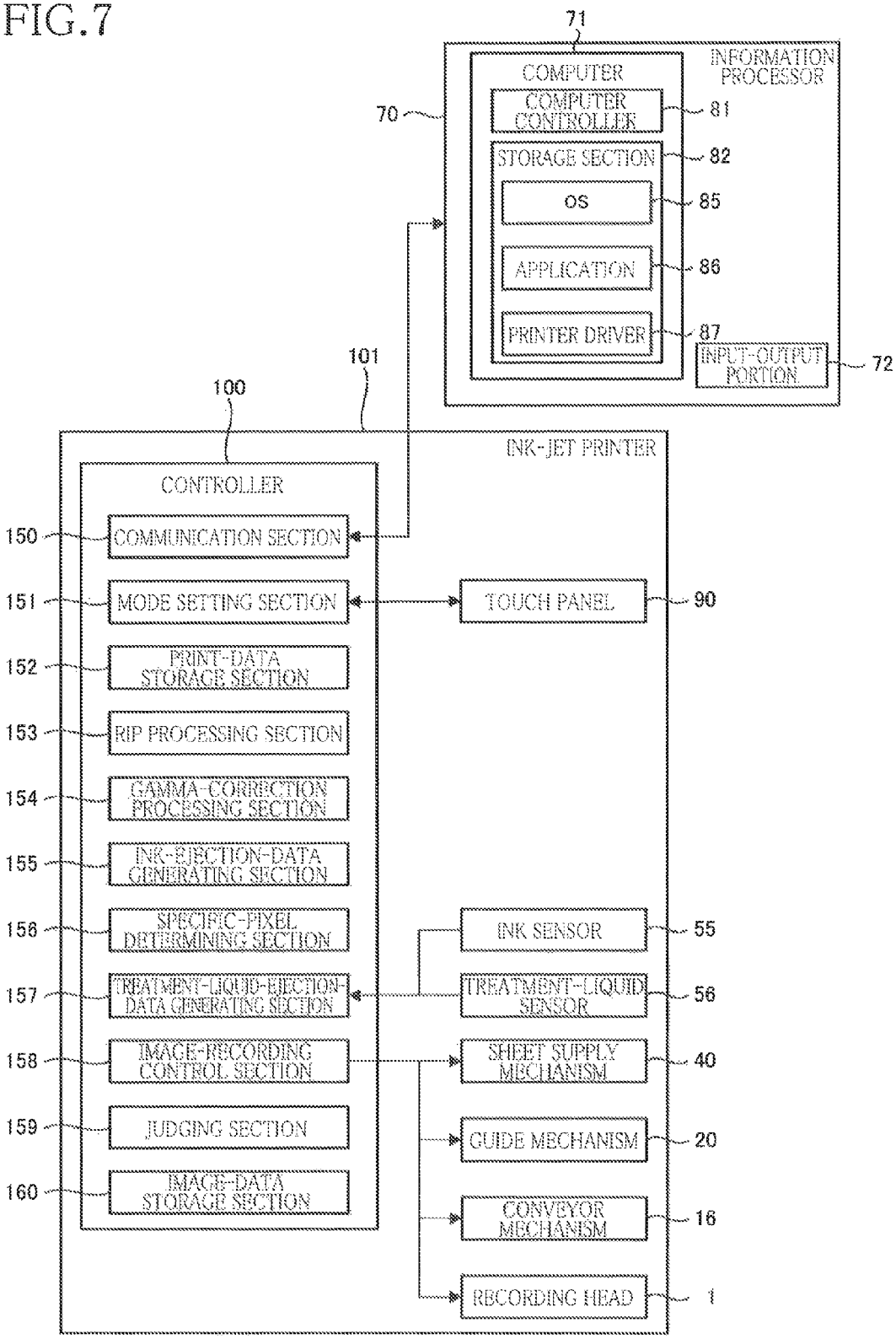
FIG. 7 is a diagram showing an electric structure of an ink-jet printer according to a second embodiment of the present invention.
Figure 8:
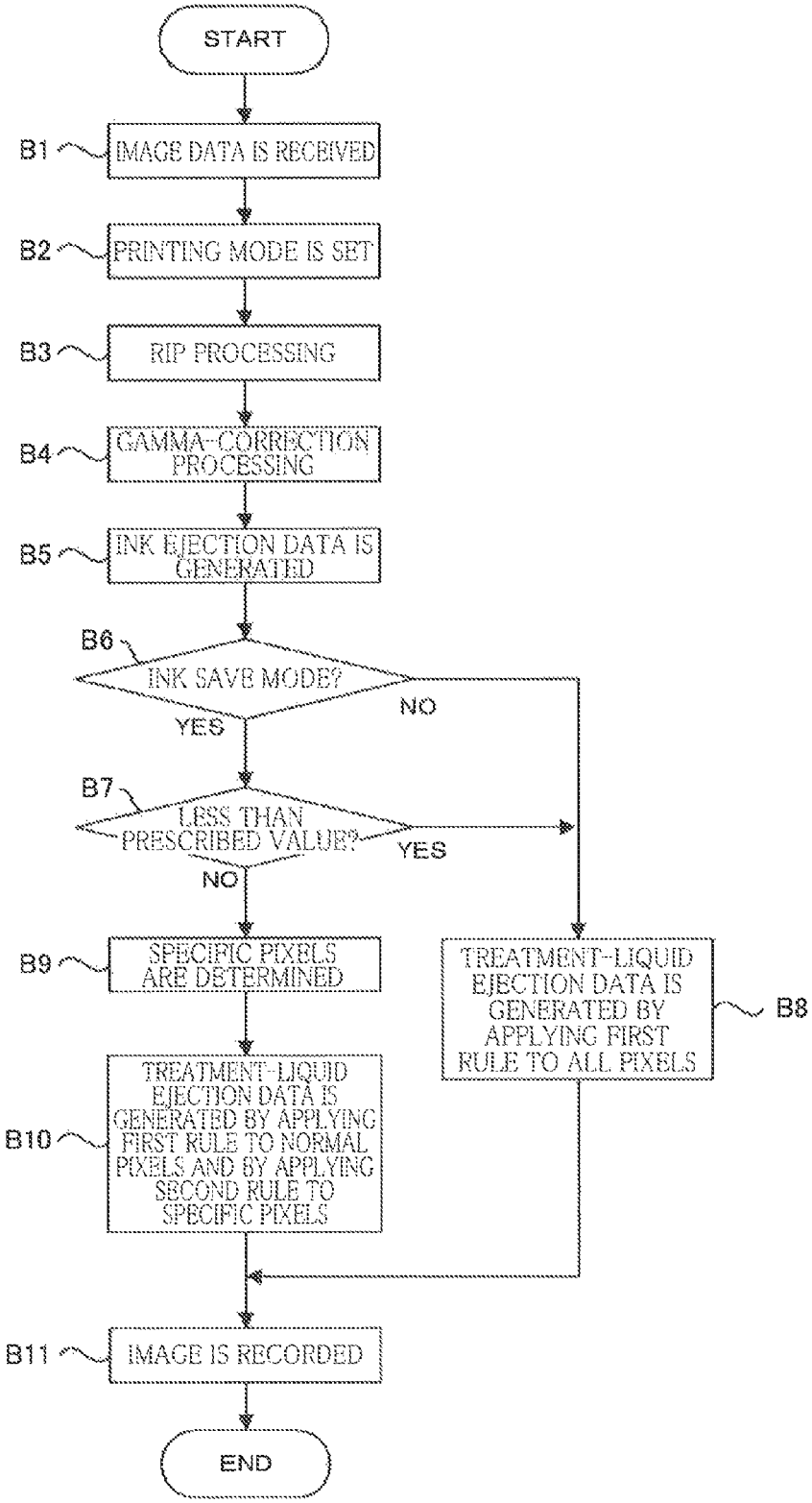
FIG. 8 is a flow chart showing an operation of the printer of FIG. 7.

Referring next to FIGS. 7 and 8, there will be explained an image recording apparatus according to a second embodiment of the invention. The second embodiment differs from the first embodiment in that, where the normal recording mode is set as the printing mode, the treatment-liquid-ejection-data generating section 157 generates the treatment-liquid ejection data by applying the first rule to all of the pixels of the recording image based on the ink ejection data. The second embodiment further differs from the first embodiment in that, even where the ink save mode is set as the printing mode, there is an instance in which the treatment-liquid ejection data is generated by applying the first rule to the specific pixels. In the following explanation, the same reference numerals as used in the first embodiment are used to identify the corresponding components and a detailed explanation thereof is dispensed with where appropriate.

In the second embodiment, as shown in FIG. 7, the controller 100 includes a judging section 159, in addition to the communication section 150, the mode setting section 151, the print-data storage section 152, the RIP processing section 153, the gamma-correction processing section 154, the ink-ejection-data generating section 155, the specific-pixel determining section 156, the treatment-liquid-ejection-data generating section 157, the image-recording control section 158, and the image-data storage section 160.

As described above, the amount of the ink stored in the ink tank 50 and the amount of the treatment liquid stored in the treatment-liquid tank 51, in an initial state, are set as follows. That is, the ratio of the amount of the treatment liquid stored in the treatment-liquid tank 51 with respect to the amount of the ink stored the ink tank 50 is equal to the ratio of the average value of the total amount of the treatment liquid ejected from the treatment-liquid ejection head 3 when an image is recorded on the sheet P with respect to the average value of the total amount of the ink ejected from the ink ejection head 2 when the image is recorded on the sheet P, in the instance in which the normal recording mode is selected as the printing mode. Therefore, where the normal recording mode is always set as the printing mode by the mode setting section 151, the timing at which the ink in the ink tank 50 runs out and the timing at which the treatment liquid in the treatment-liquid tank 51 runs out becomes substantially the same even if the treatment-liquid ejection amount is not adjusted using the specific pixels as described above.

Further, it is not necessary to adjust the treatment-liquid ejection amount using the specific pixels as described above as long as a difference between: the usage-amount ratio (that is the ratio of the usage amount of the treatment liquid ejected from the treatment-liquid ejection head 3 to the usage amount of the ink ejected from the ink ejection head 2) in an instance in which the first rule is applied to all of the pixels of the recording image based on the ink ejection data; and the usage-amount ratio in an instance in which the normal recording mode is set as the printing mode by the mode setting section 151 is less than a prescribed value, even where the ink save mode is set as the printing mode by the mode setting section 151. (The difference will be hereinafter referred to as "usage-amount-ratio difference" where appropriate.) In view of this, in the present embodiment, the judging section 159 judges whether or not the usage-amount-ratio difference is less than a prescribed value, when the ink save mode is set as the printing mode by the mode setting section 151. Here, the usage-amount ratio in the instance in which the normal recording mode is set as the printing mode by the mode setting section 151 is the ratio of the average value of the total amount of the treatment liquid ejected from the treatment-liquid ejection head 3 when an image is recorded on the sheet P with respect to the average value of the total amount of the ink ejected from the ink ejection head 2 when the image is recorded on the sheet P, in the instance in which the normal recording mode is selected as the printing mode. In other words, the usage-amount ratio in the instance in which the normal recording mode is set as the printing mode by the mode setting section 151 is the ratio of the amount of the treatment liquid stored in the treatment-liquid tank 51 to the amount of the ink stored in the ink tank 50, in the initial state.

More specifically, the judging section 159 calculates the number of the pixels corresponding to each of the droplet sizes when the ink ejection data is generated by the ink-ejection-data generating section 155. After the ink ejection data is generated by the ink-ejection-data generating section 155, the usage-amount ratio (that is the ratio of the usage amount of the treatment liquid ejected from the treatment-liquid ejection head 3 to the usage amount of the ink ejected from the ink ejection head 2) in the instance in which the first rule is applied to all of the pixels of the recording image based on the ink ejection data is obtained on the basis of the calculated number of the pixels corresponding to each of the droplet sizes. Here, as explained above, the first rule defines the relationship between the ink ejection amount and the treatment-liquid ejection amount of one pixel of the recording image based on the ink ejection data. Accordingly, the usage-amount ratio can be easily obtained by calculating the number of the pixels corresponding to each of the droplet sizes.

Subsequently, the judging section 159 judges whether or not the usage-amount-ratio difference that is a difference between the calculated usage-amount ratio and the usage-amount ratio in the instance in which the normal recording mode is set as the printing mode by the mode setting section 151 is equal to or larger than the prescribed value.

The treatment-liquid-ejection-data generating section 157 generates, on the basis of the ink ejection data generated by the ink-ejection-data generating section 155, the treatment-liquid ejection data by obtaining the output value of each of all of the pixels of the recording image based on the ink ejection data by applying the first rule to all of the pixels, where the normal recording mode is set as the printing mode by the mode setting section 151.

When the ink save mode is set as the printing mode by the mode setting section 151, the treatment-liquid-ejection-data generating section 157 generates, on the basis of the ink ejection data generated by the ink-ejection-data generating section 155, the treatment-liquid ejection data by obtaining the output value of each of all of the pixels of the recording image based on the ink ejection data by applying the first rule to all of the pixels, where it is judged by the judging section 159 that the usage-amount-ratio difference is less than the prescribed value. On the other hand, where it is judged by the judging section 159 that the usage-amount-ratio difference is equal to or larger than the prescribed value, the ink-ejection-data generating section 155 generates, on the basis of the generated ink ejection data, the treatment-liquid ejection data such that the output value of each of the normal pixels among the plurality of pixels of the recording image is obtained by applying the first rule to the normal pixels while the output value of each of the specific pixels among the plurality of pixels of the recording image is obtained by applying the second rule to the specific pixels.

<Operation of Printer>

Referring next to FIG. 8, there will be explained one example of an operation of the ink-jet printer 101 according to the second embodiment. In the second embodiment, steps B1-B5 are substantially the same as steps A1-A5 explained above with reference to FIG. 6 and an explanation thereof is dispensed with.

After the processing in step B5, the processing in step B8 is executed where the normal recording mode is set as the printing mode by the mode setting section 151 (B6: NO). On the other hand, where the ink save mode is set as the printing mode by the mode setting section 151 (B6: YES), the judging section 159 judges whether or not the usage-amount-ratio difference is equal to or larger than the prescribed value (B7). Where the judging section 159 judges that the usage-amount-ratio difference is less than the prescribed value (B7: NO), there is executed processing in step B8.

In the processing in step B8, the treatment-liquid-ejection-data generating section 157 generates, on the basis of the ink ejection data generated by the ink-ejection-data generating section 155, the treatment-liquid ejection data such that the output value of each of all of the pixels of the recording image is obtained by applying the first rule to all of the pixels. After the processing in step B8, there is executed processing in step B11.

On the other hand, where the judging section 159 judges that the usage-amount-ratio difference is equal to or larger than the prescribed value in the processing in step B7 (B7: YES), the specific-pixel determining section 156 determines the number of the specific pixels with respect to the number of all of the pixels of the recording image and the locations of the specific pixels in the recording image, on the basis of the ink ejection data generated by the ink-ejection-data generating section 155 (B9).

Subsequently, the treatment-liquid-ejection-data generating section 157 generates the treatment-liquid ejection data such that the output value of each of the normal pixels among the plurality of pixels of the recording image is obtained by applying the first rule while the output value of each of the specific pixels is obtained by applying the second rule (B10). After the processing in step B10, there is executed processing in step B11.

In step B11, the processing substantially similar to the processing in step A10 explained above with reference to FIG. 6 is executed. The operation of the ink-jet printer 101 in the second embodiment has been so far explained.

In the second embodiment, the first rule is applied to all of the pixels of the recording image where the usage-amount-ratio difference that is the difference between: the usage-amount ratio in the instance in which the first rule is applied to all of the pixels (also to the specific pixels) of the recording image based on the ink ejection data; and the usage-amount ratio in the instance in which the normal recording mode is set is less than the prescribed value, even if the ink save mode is set as the printing mode by the mode setting section 151. Accordingly, it is possible to omit the processing executed by the specific-pixel determining section 156 for determining the number of the specific pixels and the locations of the specific pixels, resulting in a reduction of the load of the controller 100 to execute the processing.

<Third Embodiment>

There will be next explained an image recording apparatus according to a third embodiment of the present invention. The third embodiment differs from the first embodiment in that treatment-liquid-ejection-data generating section 157 generates the treatment-liquid ejection data such that the output value of each of the specific pixels is obtained by applying the second rule even where the normal recording mode is set as the printing mode. In other words, the third embodiment differs from the first embodiment in that the second rule is a rule common to the normal recording mode and the ink save mode, for the specific pixels. The relationship shown in FIG. 5B may be applied always as the second rule. It is noted, however, that the second rule used here may be defined in a way different from that in the first embodiment as long as the second rule defines the relationship between the ink ejection amount and the treatment-liquid ejection amount for one pixel of the recording image based on the ink ejection data. In the following explanation, the same reference numerals as used in the illustrated first embodiment are used to identify the corresponding components, and an explanation thereof is dispensed with where appropriate.

In the third embodiment, the treatment-liquid ejection data is generated by applying the second rule to the specific pixels even where the normal recording mode is set as the printing mode. Accordingly, in an instance where the number of the specific pixels for the same image data transmitted from the information processor 70 is smaller in the ink save mode than in the normal recording mode, it is not possible to reduce a difference in the usage-amount ratio between the normal recording mode and the ink save mode. In other words, the usage-amount ratio (that is the ratio of the usage amount of the treatment liquid to the usage amount of the ink) in the instance in which the normal recording mode is set as the printing mode cannot be made close to the remaining-amount ratio (that is the ratio of the treatment-liquid remaining amount in the treatment-liquid tank 51 to the ink remaining amount in the ink tank 50).

In view of the above, in the present embodiment, where the ink save mode is set by the mode setting section 151, the specific-pixel determining section 156 determines the number of the specific pixels, such that the usage-amount ratio in an instance in which the second rule is applied to the specific pixels in the number that is determined in the second mode is closer to the remaining-amount ratio, as compared with the usage-amount ratio in an instance in which the second rule is applied to the specific pixels in a number that is determined according to a rule in the normal recording mode.

More specifically, the mask pattern used by the specific-pixel determining section 156 when the ink save mode is set by the mode setting section 151 has a pixel-removal rate smaller than the mask pattern used by the specific-pixel determining section 156 when the normal recording mode is set the mode setting section 151. In the arrangement, where the ink save mode is set by the mode setting section 151, the specific-pixel determining section 156 obtains the pixels located in the solid portion of the recording image among the plurality of pixels of the recording image based on the ink ejection data and removes pixels using the mask pattern indicated above. In this case, the number of the pixels that remain in the solid portion without being removed increases, whereby the number of the specific pixels can be increased. It is therefore possible to reduce the difference in the usage-amount ratio between the normal recording mode and the ink save mode. Further, the rule applied to the specific pixels is the second rule common to the normal recording mode and the ink save mode, thereby simplifying generation of the treatment-liquid ejection data.

<Other Embodiments>

While the embodiments of the present invention have been described above, it is to be understood that the present invention is not limited to the details of the illustrated embodiments, but may be embodied with various other changes and modifications, which may occur to those skilled in the art, without departing from the scope of the invention defined in the attached claims. In the illustrated embodiments, the controller 100 of the ink-jet printer 101 includes the mode setting section 151, the RIP processing section 153, the gamma-correction processing section 154, the ink-ejection-data generating section 155, the specific-pixel determining section 156, and the treatment-liquid-ejection-data generating section 157. The computer 71 of the information processor 70 may include those functional sections. That is, the functional sections may be established by activating the printer driver 87 stored in the storage section 82 of the computer 71 of the information processor 70, and the ink ejection data generated by the ink-ejection-data generating section 155 and the treatment-liquid ejection data generated by the treatment-liquid-ejection-data generating section 157 may be outputted to the ink-jet printer 101.

In the illustrated embodiments, the printing mode includes the two modes, i.e., the normal recording mode and the ink save mode. The printing mode may include three or more modes. For instance, the printing mode may include a high-density mode in which an image is recorded on the sheet P in a density higher than that in the normal recording mode. Where the high-density mode is selected as the printing mode, the gradient of the inclined line that represents the relationship between the input density value and the output density value shown in FIG. 3A may be made steeper by the gamma-correction processing section 154 in the high-density mode, as compared with that in the normal recording mode. Further, in the high-density mode, the second rule may be modified such that the usage amount of the treatment liquid ejected from the treatment-liquid ejection head 3 is made larger, as compared with an instance in which the first rule is applied also to the specific pixels, where the droplet sizes that can be ejected from the ink ejection head 2 and the treatment-liquid ejection head 3 are set as indicated in FIG. 5E.

The recording medium is not limited to the sheet P, but may be various recordable media. In the illustrated embodiments, the ink ejection head 2 for ejecting the ink and the treatment-liquid ejection head 3 for ejecting the treatment liquid are separately provided. Those heads 2 and 3 may be integrally provided. Further, while the treatment liquid is ejected to the sheet P prior to ejection of the ink thereto in the illustrated embodiments, the treatment liquid may be ejected to the sheet P after ejection of the ink thereto.

When the ink ejection data is generated by the ink-ejection-data generating section 155, the number of the pixels corresponding to each droplet size may be calculated. Then, on the basis of the calculated number of the pixels corresponding to each droplet size, the treatment-liquid ejection data may be generated by applying the first rule to all of the pixels of the recording image based on the ink ejection data, where a difference between: the usage-amount ratio in the instance in which the first rule is applied to all of the pixels of the recording image based on the ink ejection data; and the above-indicated remaining-amount ratio is less than a prescribed value.

What is claimed is:

1. An image recording apparatus, comprising:

a recording head configured to eject, to a recording medium, a first liquid by which an image is recorded on the recording medium and a second liquid that acts on the first liquid so as to improve characteristics of the first liquid; and a controller configured to control the recording head, wherein the controller is configured to perform:

mode setting processing in which the controller selectively sets one of a plurality of modes including a first mode in which an image to be recorded based on image data is identified as a recording image which is an image to be recorded and a second mode in which an image having a density different from a density of the image to be recorded based on the image data in the first mode is identified as the recording image, the image data containing density values each for a corresponding one of a plurality of pixels arranged in matrix;

first-data generating processing in which the controller generates first-liquid ejection data indicating an ejection amount of the first liquid for each of the plurality of pixels of the recording image;

second-data generating processing in which the controller generates second-liquid ejection data indicating an ejection amount of the second liquid for each of the plurality of pixels of the recording image; and image-recording-control processing in which the controller controls the recording head to eject the first liquid and the second liquid to the recording medium according to the first-liquid ejection data and the second-liquid ejection data, wherein the controller generates the second-liquid ejection data in the second-data generating processing such that, where the second mode is set in the mode setting processing, the ejection amount of the second liquid for each pixel other than specific pixels in the plurality of pixels of the recording image is obtained by applying a first rule common to the plurality of modes while the ejection amount of the second liquid for each of the specific pixels is obtained by applying a second rule that corresponds to the second mode and that is different from the first rule, and wherein, where a ratio of a usage amount of the second liquid ejected from the recording head with respect to a usage amount of the first liquid ejected from the recording head is defined as a usage-amount ratio, the second rule is a rule by which the usage-amount ratio in an instance in which the second rule is applied to the specific pixels in the second mode is made closer to the usage-amount ratio in an instance in which the first mode is set in the mode setting processing, as compared with the usage-amount ratio in an instance in which the first rule is applied to the specific pixels in the second mode.

2. The image recording apparatus according to claim 1, wherein the first rule is a rule that defines a relationship between the ejection amount of the first liquid and the ejection amount of the second liquid, for one pixel in the plurality of pixels of the recording image, and wherein the controller generates the second-liquid ejection data in the second-data generating processing such that the ejection amount of the second liquid is obtained for each of first-rule-applicable pixels, based on the ejection amount of the first liquid for said each of the first-rule-applicable pixels in the first-liquid ejection data generated in the first-data generating processing, the first-rule-applicable pixels being pixels to which the first rule is applied in the plurality of pixels of the recording image.

3. The image recording apparatus according to claim 2, wherein, as the ejection amount of the first liquid that can be ejected from the recording head for the one pixel in the plurality of pixels of the recording image, there are set at least zero, a first ejection amount larger than zero, and a second ejection amount larger than the first ejection amount, and wherein, as the ejection amount of the second liquid that can be ejected from the recording head for the one pixel in the plurality of pixels of the recording image, there are set at least zero, a first ejection amount larger than zero, and a second ejection amount larger than the first ejection amount, and wherein a ratio between the first ejection amount of the first liquid and the first ejection amount of the second liquid differs from a ratio between the second ejection amount of the first liquid and the second ejection amount of the second liquid.

4. The image recording apparatus according to claim 2, wherein, as the ejection amount of the first liquid that can be ejected from the recording head for the one pixel in the plurality of pixels of the recording image, there are set at least zero, a first ejection amount larger than zero, and a second ejection amount larger than the first ejection amount, and wherein a ratio between the first ejection amount and the ejection amount of the second liquid that is determined, by the first rule, to be ejected in accordance with the first ejection amount differs from a ratio between the second ejection amount and the ejection amount of the second liquid that is determined, by the first rule, to be ejected in accordance with the second ejection amount.

5. The image recording apparatus according to claim 1, wherein the controller is configured to further perform specific-pixel determining processing in which the controller determines a number of the specific pixels with respect to a number of the plurality of pixels and locations of the specific pixels in the recording image, for at least the recording image in the second mode.

6. The image recording apparatus according to claim 5, wherein the controller determines, in the specific-pixel determining processing, the number of the specific pixels with respect to the number of the plurality of pixels and the locations of the specific pixels in the recording image, for the recording image in the first mode, in addition to the recording image in the second mode, wherein the controller generates the second-liquid ejection data in the second-data generating processing such that, where the first mode is set in the mode setting processing, the ejection amount of the second liquid for each of the specific pixels is obtained by applying a third rule to each of the specific pixels, and wherein the usage-amount ratio in an instance in which the third rule is applied to the specific pixels is closer to a prescribed target value, as compared with the usage-amount ratio in an instance in which the third rule is not applied to the specific pixels.

7. The image recording apparatus according to claim 6, further comprising: a first tank that stores the first liquid to be supplied to the recording head; and a second tank that stores the second liquid to be supplied to the recording head, wherein the prescribed target value is a ratio of a remaining amount of the second liquid in the second tank with respect to a remaining amount of the first liquid in the first tank.

8. The image recording apparatus according to claim 5, wherein the controller determines, in the specific-pixel determining processing, the number of the specific pixels with respect to the number of the plurality of pixels and the locations of the specific pixels in the recording image, for the recording image in the first mode, in addition to the recording image in the second mode, wherein the controller generates the second-liquid ejection data in the second-data generating processing such that the ejection amount of the second liquid for each of the specific pixels is obtained by applying the second rule to each of the specific pixels, not only where the second mode is set in the mode setting processing but also where the first mode is set in the mode setting processing, and wherein, where the second mode is set in the mode setting processing, the controller determines, in the specific-pixel determining processing, the number of the specific pixels in the second mode, such that the usage-amount ratio in an instance in which the second rule is applied to the specific pixels in the number is closer to a prescribed target value as compared with the usage-amount ratio in an instance in which the second rule is applied to the specific pixels in a number that is determined according to a rule in the first mode.

9. The image recording apparatus according to claim 8, further comprising: a first tank that stores the first liquid to be supplied to the recording head; and a second tank that stores the second liquid to be supplied to the recording head, wherein the prescribed target value is a ratio of a remaining amount of the second liquid in the second tank with respect to a remaining amount of the first liquid in the first tank.

10. The image recording apparatus according to claim 1, wherein, where the second mode is set in the mode setting processing, the controller further performs judgment processing in which the controller judges whether a difference between: the usage-amount ratio in an instance in which the first rule is applied also to the specific pixels; and the usage-amount ratio in an instance in which the first mode is set in the mode setting processing is equal to or larger than a prescribed value, wherein the controller generates the second-liquid ejection data in the second-data generating processing by applying the second rule to the specific pixels, where the controller judges that the difference is equal to or larger than the prescribed value while the controller generates the second-liquid ejection data in the second-data generating processing by applying the first rule also to the specific pixels where the controller judges that the difference is less than the prescribed value.

11. The image recording apparatus according to claim 1, wherein the specific pixels are located in a solid portion of the recording image, and wherein the solid portion is constituted by some pixels in the plurality of pixels of the recording image, the ejection amount of the first liquid of each of all of adjoining pixels that adjoin each of the some pixels being larger than zero, the ejection amount of the first liquid being indicated by the first-liquid ejection data.

12. The image recording apparatus according to claim 1, wherein the second mode is a mode in which an image having a density lower than the density of the image to be recorded based on the image data in the first mode is identified as the recording image, and wherein the second rule is a rule by which the usage-amount ratio in the instance in which the second rule is applied to the specific pixels in the second mode is made smaller than the usage-amount ratio in the instance in which the first rule is applied to the specific pixels in the second mode.

13. A non-transitory computer-readable storage medium in which is stored an image processing program to be executed by a computer of information processing device that is communicable with an image recording apparatus having a recording head configured to eject, to a recording medium, a first liquid by which an image is recorded on the recording medium and a second liquid that acts on the first liquid so as to improve characteristics of the first liquid, wherein the image processing program permits the computer to function as a controller to perform:

mode setting processing in which the controller selectively sets one of a plurality of modes including a first mode in which an image to be recorded based on image data is identified as a recording image which is an image to be recorded and a second mode in which an image having a density different from a density of the image to be recorded based on the image data in the first mode is identified as the recording image, the image data containing density values each for a corresponding one of a plurality of pixels arranged in matrix;

first-data generating processing in which the controller generates first-liquid ejection data indicating an ejection amount of the first liquid for each of the plurality of pixels of the recording image;

second-data generating processing in which the controller generates second-liquid ejection data indicating an ejection amount of the second liquid for each of the plurality of pixels of the recording image; and image-recording-control processing in which the controller controls the recording head to eject the first liquid and the second liquid to the recording medium according to the first-liquid ejection data and the second-liquid ejection data, wherein the controller generates the second-liquid ejection data in the second-data generating processing such that, where the second mode is set in the mode setting processing, the ejection amount of the second liquid for each pixel other than specific pixels in the plurality of pixels of the recording image is obtained by applying a first rule common to the plurality of modes while the ejection amount of the second liquid for each of the specific pixels is obtained by applying a second rule that corresponds to the second mode and that is different from the first rule, and wherein, where a ratio of a usage amount of the second liquid ejected from the recording head with respect to a usage amount of the first liquid ejected from the recording head is defined as a usage-amount ratio, the second rule is a rule by which the usage-amount ratio in an instance in which the second rule is applied to the specific pixels in the second mode is made closer to the usage-amount ratio in an instance in which the first mode is set in the mode setting processing, as compared with the usage-amount ratio in an instance in which the first rule is applied to the specific pixels in the second mode.

* * * * *